US007837356B2

(12) United States Patent
Van De Poel

(10) Patent No.: US 7,837,356 B2
(45) Date of Patent: Nov. 23, 2010

(54) REFLECTOR LAMP WITH OUTER BULB

(75) Inventor: Gunther Van De Poel, Waanrode (BE)

(73) Assignee: Flowil International Lighting (Holding) B.V., Amsterdam (NL)

( * ) Notice: Subject to any disclaimer, the term of this patent is extended or adjusted under 35 U.S.C. 154(b) by 0 days.

(21) Appl. No.: 12/047,476

(22) Filed: Mar. 13, 2008

(65) Prior Publication Data

US 2008/0225529 A1 Sep. 18, 2008

(30) Foreign Application Priority Data

Mar. 16, 2007 (EP) ..... 07104360

(51) Int. Cl.
*H01J 1/18* (2006.01)
*H01J 19/00* (2006.01)

(52) U.S. Cl. ..... 362/263; 362/261; 313/25; 313/238; 313/239; 313/292

(58) Field of Classification Search ..... 313/25, 313/238, 239, 292, 580, 634; 362/261, 263
See application file for complete search history.

(56) References Cited

U.S. PATENT DOCUMENTS 5,043,623 A 8/1991 Scholz et al. ..... 313/25
5,252,885 A * 10/1993 Muzeroll et al. ..... 313/25
5,493,167 A * 2/1996 Mikol et al. ..... 313/25
5,594,295 A * 1/1997 Van Gennip et al. ..... 313/25
6,741,013 B2 * 5/2004 Dakin et al. ..... 313/25
6,930,443 B2 * 8/2005 Williamson et al. ..... 313/238

FOREIGN PATENT DOCUMENTS

| | | |
|---|---|---|
| DE | 102 33 073 B3 | 2/2004 |
| EP | 1 391 914 A2 | 7/2003 |
| EP | 1 708 229 A1 | 3/2006 |
| JP | 07065790 | 3/1995 |
| JP | 2005135665 | 5/2005 |

OTHER PUBLICATIONS

European Search Report for related application Serial No. EP07104360.8.

* cited by examiner

*Primary Examiner*—Jacob Y Choi
(74) *Attorney, Agent, or Firm*—Westman, Champlin & Kelly, P.A.

(57) ABSTRACT

Reflector lamp, particularly metal halogen vapor reflector lamp, comprising a reflector, which is rotationally symmetric about a central axis and which encloses, together with a cover, a lamp interior and which tapers toward a neck region opposite the cover, wherein a burner comprising a burner space and also pinched seals, which lie diametrically opposite each other on opposing sides of the burner space and through which corresponding supply lines are run, is arranged on the central axis in the lamp interior, wherein a tubular shielding enclosure, which is connected to the burner by means of a spring clip, is provided at least partially surrounding the burner.

9 Claims, 2 Drawing Sheets

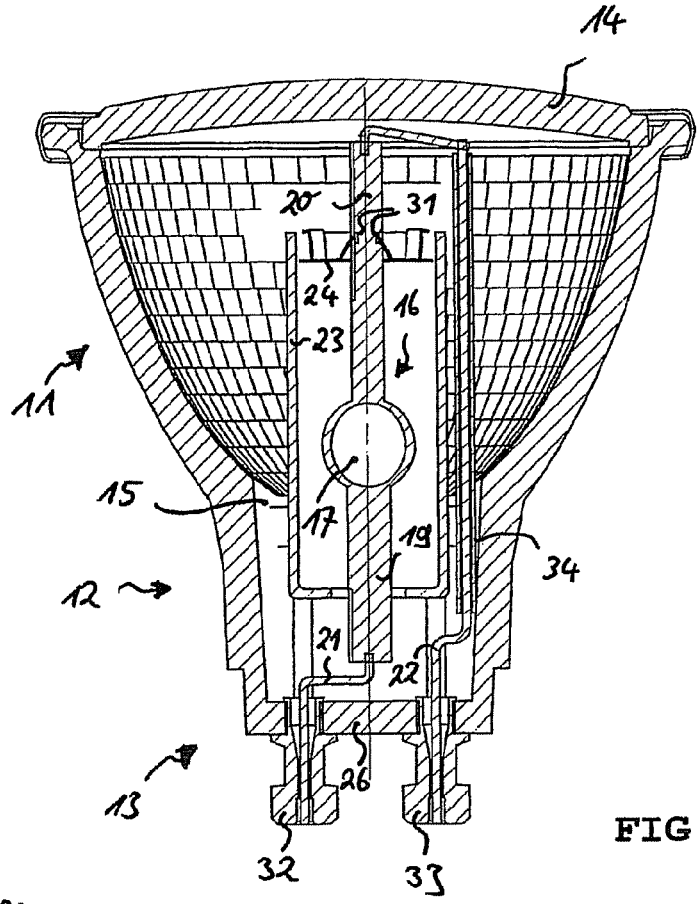
FIG 1
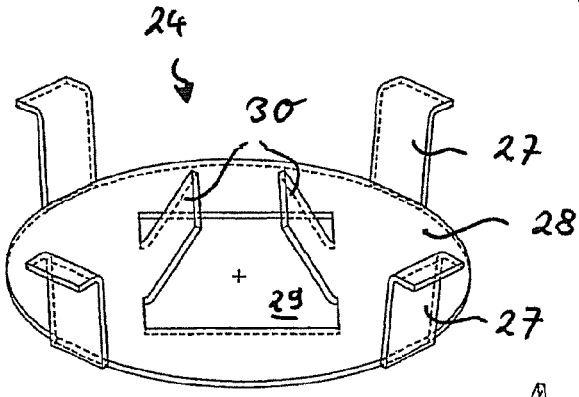
FIG 2
FIG 3
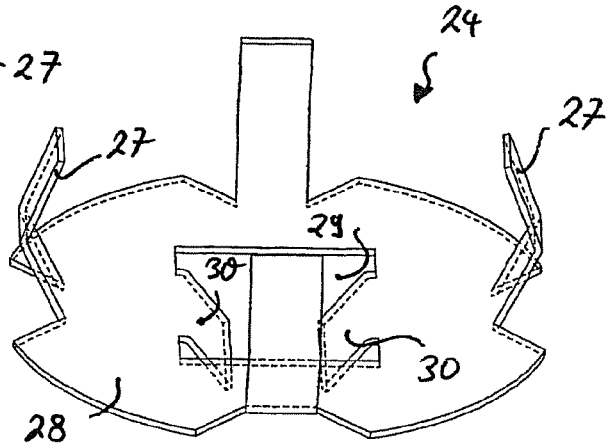

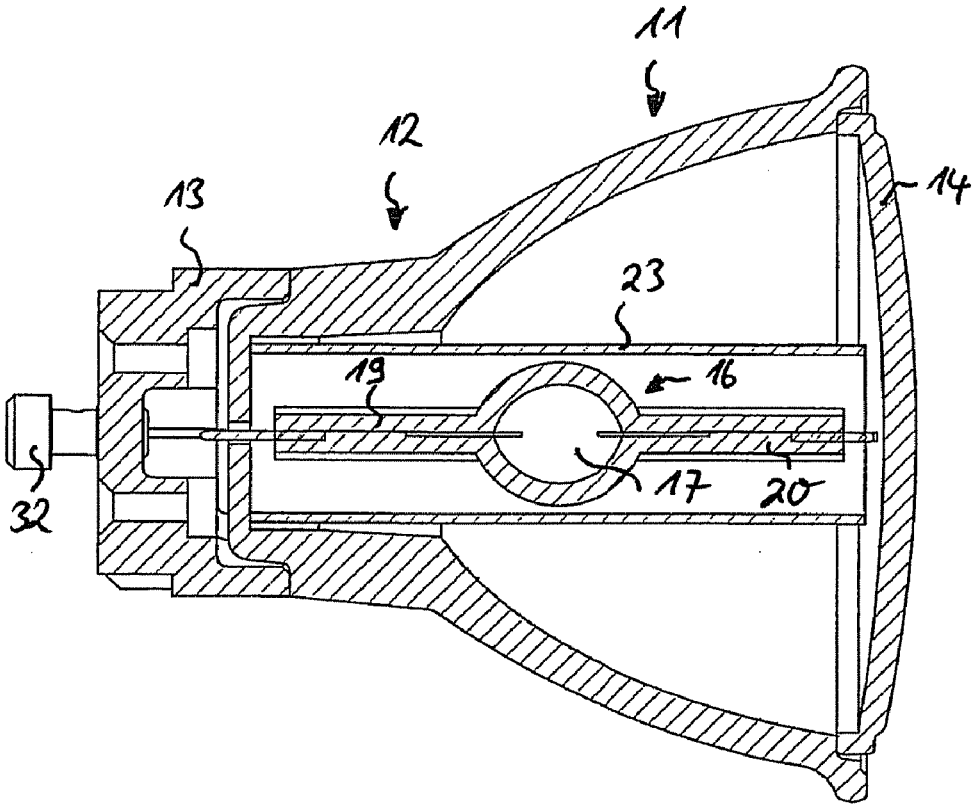
FIG 4
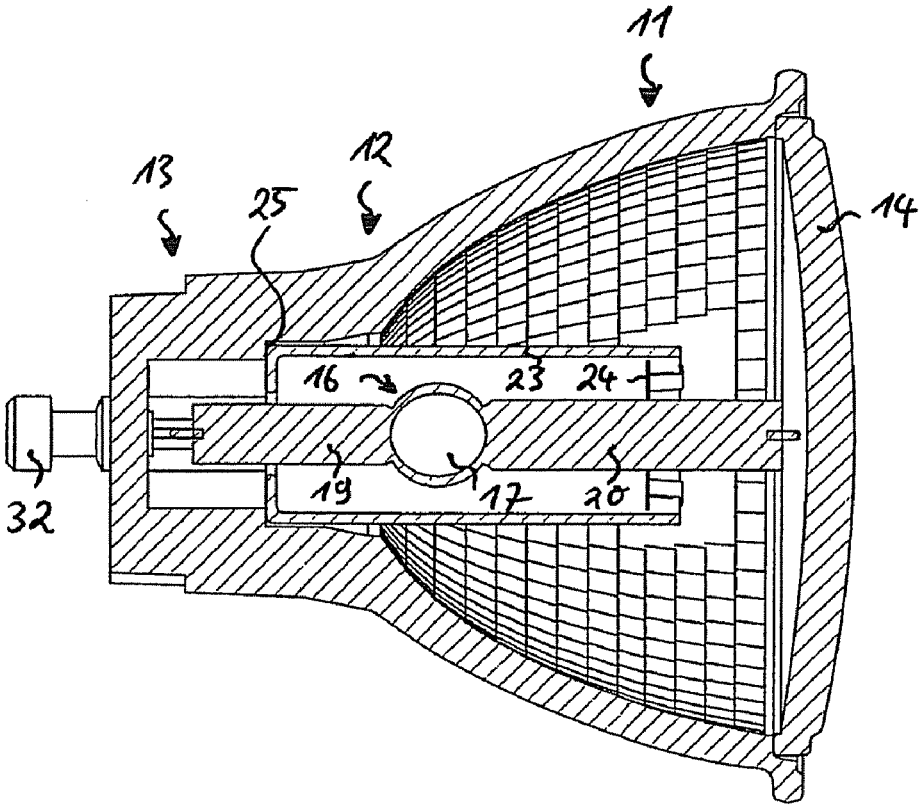

REFLECTOR LAMP WITH OUTER BULB

The present application claims priority of European patent application Serial No. 07104360.8, filed Mar. 16, 2007, the content of which is hereby incorporated by reference in its entirety.

BACKGROUND OF THE INVENTION

The invention relates to a reflector lamp; in particular, a metal halogen vapor reflector lamp comprising a reflector, which is rotationally symmetric about a central axis and which encloses, together with a cover, a lamp interior and which tapers toward a neck region opposite the cover, wherein a burner comprising a burner space as well as pinched seals, which lie diametrically opposite each other on opposing sides of the burner space and through which supply lines are run, is arranged on the central axis in the lamp interior, wherein a tubular shielding enclosure is provided at least partially surrounding the burner.

Such a reflector lamp is already known, for example, from DE 102 33 073. In this publication, the problem of attaching the tubular shielding enclosure on one side as well as the burner on the other side has also already been addressed. In practice, it has been proposed in the state of the art to fix the burner and tubular shielding enclosure by means of the supply line facing the cover. Furthermore, it is also proposed there to fix the tubular shielding enclosure through cement relative to the reflector.

The measures proposed there for fixing the tubular shielding enclosure on one side and the burner on the other respective side, however, have proven to be relatively complicated in production.

SUMMARY OF THE INVENTION

The present invention includes an alternative arrangement, which achieves at least the fixing of the tubular shielding enclosure and burner relative to each other in a reliable way that can be easily realized in production. Advantageous refinements are specified in the subordinate claims.

BRIEF DESCRIPTION OF THE DRAWINGS

Shown herein are:

FIG. 1, a section view through an embodiment of a reflector lamp according to the invention, FIG. 2, a perspective view of the spring clip used in the embodiment according to FIG. 1, FIG. 3, an alternative embodiment of a spring clip, FIG. 4, a comparison of an embodiment of a reflector lamp built according to the invention with a reflector lamp according to the state of the art, wherein the lamp according to the invention is built significantly shorter overall despite even larger overall length of the burner by means of two pinched sections.

DETAILED DESCRIPTION OF ILLUSTRATIVE EMBODIMENTS

The basic concept of the present invention is to connect the burner to the tubular shielding enclosure by means of a spring clip. In one specific, preferred construction, the spring clip directly engages both the burner, particularly, on one of its pinched seals, on one side, and on the tubular shielding enclosure, preferably on one of its edges, on the other side. The spring clip is here preferably a separate component and connected neither mechanically nor electrically to one of the supply lines.

Furthermore, the spring clip can be used as a cooling element and the temperatures in the region of the distal ends of the pinched seals can be significantly reduced. On only the side on which the spring clip is attached, it acts as a screen, so that the region of the pinched seal screened by the spring clip is kept significantly cooler relative to the temperatures close to the burner space.

In one specific, preferred implementation, the spring clip fixes the tubular shielding enclosure against a stop in the neck region of the reflector.

In another preferred implementation, the dimensions are set so that the spring clip presses the tubular shielding enclosure against the stop under a biasing force. In this implementation, an especially reliable, insensitive fixing of the tubular shielding enclosure, but also of the burner, is effected within the tubular shielding enclosure.

In a first preferred implementation, the spring clip engages an end of the tubular shielding enclosure facing the cover. Only the mutual fixing of the tubular shielding enclosure and burner in a region of the lamp interior opposite the neck region appears to be meaningful, because the tubular shielding enclosure and also the burner can be fixed in the neck region directly opposite the reflector or components connected to the reflector in a stable way and thus, an also independent anchoring or fixing of the tubular shielding enclosure and burner is possible in a relatively simple way.

In one alternative implementation, however, it is also conceivable that the spring clip engages an end of the tubular shielding enclosure facing away from the cover, thus, on the end facing the neck region of the reflector.

In one specific, preferred construction, the spring clip can include catch means, particularly catch tabs, which are constructed for engaging in one or more recesses on the burner, especially on the pinched seal facing the cover or pinched seal facing away from the cover.

According to one especially preferred aspect of the present invention, the burner is held exclusively by means of supply lines guided through a base, which lies opposite the cover and which is connected to the reflector or is formed integrally with the reflector, as well as by the tubular shielding enclosure, which is connected to the burner by means of the spring clip, in particular, held aligned with the central axis.

The spring clip can be formed from metal; in particular, spring steel, or from a suitable alternative metal.

On the outside the spring clip can include several fastening elements, particularly, fastening tabs. These fastening tabs can be constructed, as illustrated below with reference to embodiments, to be supported on the tubular shielding enclosure from the inside. They can also completely or partially surround the edge of the tubular shielding enclosure or can also be supported from the outside relative to the tubular shielding enclosure.

Furthermore, the spring clip can feature a central ground structure, in particular, a central, circular ground plate.

A central opening can be formed in the circular ground plate of the spring clip through which the associated pinched seal of the burner can be guided. In this respect, the spring clip encloses a section of the burner, particularly a section of an associated pinched seal of the burner.

On the edge of the central opening one or more, in particular, two catch tabs can be formed for engaging in the recesses on the associated pinched seal.

The invention will be explained in more detail below with respect to additional features and advantages with reference to the description of embodiments and with reference to the enclosed drawings.

In FIG. 1, a section view through one embodiment of a reflector lamp according to the invention is shown. The reflector lamp first comprises a rotationally symmetric reflector 11, which encloses, together with a cover 14 that can be constructed, for example, as a lens, a lamp interior 15. On its end facing away from the cover 14, the reflector 11 tapers and forms a neck region 12. On the end, the reflector 11 is closed with an integral base 26, through which supply lines 21, 22 are guided. The supply lines 21, 22 are gripped in contact pins 32, 33 outside the reflector 11. A sub-section of the neck region 12 facing the bottom 26, the bottom 26, and also the contact pins 32, 33 form a base 13 of the reflector lamp. The base 13 allows a mechanical and electrical connection of the reflector lamp to a corresponding bracket.

In the lamp interior 15, a burner 16 is arranged on the central axis. The burner 16 has two pinched seals 19, 20 on the ends and a burner space 17 there-between. Around the burner 16 is a tubular shielding enclosure 23, which encloses the burner 16 in such a way that it projects from the tubular shielding enclosure 23 at the end only past its pinched seals 19, 20. The tubular shielding enclosure 23 contacts stops 25 (cf. FIG. 4, bottom) in the neck region 12 of the reflector 11.

The tubular shielding enclosure 23 can be formed, for example, from quartz or glass.

The burner 16 and tubular shielding enclosure 23 are fixed relative to each other at their end facing the cover 14 by means of a spring clip 24. For this purpose, on the outside, the spring clip 24 has several, here actually four (cf. FIG. 2) mounting plates 27, which are provided for contacting the tubular shielding enclosure 23. The mounting plates are bent outwardly at a certain angle, preferably from 5° to 10°, wherein this outward bending becomes approximately zero, that is, the mounting plates 27 are oriented along the central axis once they contact the tubular shielding enclosure 23 under predetermined biasing. The mounting plates 27 have at their distal end an approximately 90° bend with a length of ca. 1 mm, which is provided for contacting the end edge of the tubular shielding enclosure 23. The mounting plates 27 thus have a dual function, namely, to orient the tubular shielding enclosure 23 parallel to the optical axis and to lock the tubular shielding enclosure between the stops 25 and the recesses 31 in the pinched seal 20.

In order to prevent or reduce sodium loss, the tubular shielding enclosure 23 can be bent slightly inwardly on the opposite side.

The stops 25 are used simultaneously to orient the tubular shielding enclosure 23 also laterally, so that it is positioned exactly along the optical axis.

A central opening 29 is provided, through which the pinched seal 20 facing the cover 14 emerges, within a circular base plate 28 of the spring clip 24. At the edge of the central opening 29 there are one or more catch tabs 30, here, actually two catch tabs, which engage in recesses 31 in the pinched seal 20 and thus lock the spring clip 24 in its elongated position relative to the longitudinal extent of the burner 16. Simultaneously, the dimensions are set so that the tubular shielding enclosure 23 is pressed under slight biasing onto the stops 25 on the reflector 11 and thus fixed. Instead of recesses 31 in the pinched seal 20, thicker sections could also be formed, so that the catch tabs 30 can be pushed over the thicker sections and can engage behind the thicker sections.

The embodiment of a spring clip 24 already explained with reference to FIG. 1 is shown in FIG. 2 in an enlarged in a perspective view. An alternative embodiment of a spring clip 24 is shown in perspective view in FIG. 3. For this embodiment, an at least essentially circular base plate 28 is also provided, wherein here mounting plates 27 and catch tabs 30 project from the base plate 28 not in the same direction but in opposite directions.

In the embodiment according to FIG. 2, while the circular base plate 28 is dimensioned so that it can be inserted into the tubular shielding enclosure 23, it is provided in the embodiment according to FIG. 3 that the at least essentially circular base plate 28 contacts the end edge of the tubular shielding enclosure 23 and that the mounting plates 27 are inserted into the tubular shielding enclosure 23. It is also possible to lock the tubular shielding enclosure on both sides of the burner space 17 with two spring clips 24 so that, in some circumstances, the fixing in the axial and lateral direction can be eliminated in the region of the stops 25.

In addition to the tubular shielding enclosure 23, the supply line 22 fed from the cover 14 also contributes to fixing the burner 16 exactly on the optical axis. For this purpose, the supply line 22 is run in a shielding tube 34, which can in turn be held on the optical axis in a cylindrical groove for increasing the stability and for improving the fixing of the burner 16.

In FIG. 4, a comparison of one embodiment of a reflector lamp built according to the invention (bottom) with a reflector lamp according to the state of the art (top) is shown, wherein the reflector lamp according to the invention has an overall significantly shorter structure (ca. 8%) even despite a greater overall length of the burner 16 by means of two pinched sections 19, 20. This relates to the fact that the lamp interior 15 can have a continuous structure up to the bottom 26 of the reflector 11, and thus the reflector 11 can directly form a part of the base 13.

Although the present invention has been described with reference to preferred embodiments, workers skilled in the art will recognize that changes may be made in form and detail without departing from the spirit and scope of the invention.

LIST OF REFERENCE SYMBOLS

11 Reflector
12 Neck region
13 Base
14 Cover
15 Lamp interior
16 Burner
17 Burner space
19, 20 Pinched seals
21, 22 Supply lines
23 Tubular shielding enclosure
24 Spring clip
25 Stop
26 Bottom
27 Mounting plates
28 Circular base plate
29 Central opening
30 Catch tabs
31 Recesses
32, 33 Contact pins
34 Shielding tube

What Is claimed Is:

1. Reflector lamp, in particular, a metal halogen vapor reflector lamp, comprising a reflector, which is rotationally symmetric about a central axis and which encloses a lamp interior together with a cover and which tapers toward a neck region opposite the cover, wherein a burner comprising a burner space and also pinched seals, which lie diametrically opposite each other on opposing sides of the burner space and through which supply lines are run, is arranged on the central axis in the lamp interior, characterized in that a tubular shielding enclosure at least partially surrounding the burner, contacts stop in the neck region of the reflector, the tubular shielding enclosure comprising quartz or glass; and wherein the burner and the tubular shielding enclosure are connected by means of a single spring clip mounted on the pinched seal of the burner, the arrangement being such that the spring clip interacts with the stop by pressing the tubular shielding enclosure against the stop under a biasing force, wherein the spring clip includes catch means, especially catch tabs, for locking engagement in one or more recesses on the burner, especially on the pinched seal facing the cover or the pinched seal facing away from the cover.

2. Reflector lamp according to claim 1, characterized in that the spring clip engages an end of the tubular shielding enclosure facing the cover.

3. Reflector lamp according to claim 1, characterized in that the spring clip engages an end of the tubular shielding enclosure facing away from the cover.

4. Reflector lamp according to claim 1, characterized in that the burner is held oriented with the central axis exclusively by means of the supply lines which are connected to the metal contacts pressed in the bottom of the glass reflector, lying opposite to the cover, as well as by the tubular shielding enclosure, which is connected by means of the spring clip to the burner.

5. Reflector lamp according to claim 1, characterized in that the spring clip is made from metal, particularly spring steel.

6. Reflector lamp according to claim 1, characterized in that the spring clip includes, on the outside, several mounting elements, particularly mounting plates.

7. Reflector lamp according to claim 1, characterized in that the spring clip includes a central base structure, particularly a central circular base plate.

8. Reflector lamp according to claim 1, characterized in that a central opening through which the associated pinched seal is guidable, is constructed in the circular base plate.

9. Reflector lamp according to claim 8, characterized in that one or more, particularly two, catch tabs are constructed at the edge on the central opening for engaging in the recesses on the associated pinched seal.

* * * * *